United States Patent [19]

Wiersema et al.

[11] Patent Number: 4,587,824

[45] Date of Patent: May 13, 1986

[54] CONDUCTOR BUNDLE EDGE-BENDING TOOL FOR A DYNAMOELECTRIC GENERATOR

[75] Inventors: Dale T. Wiersema, Bellevue; Fred Kirschensteiner, Forest Hills, both of Pa.

[73] Assignee: Westinghouse Electric Corp., Pittsburgh, Pa.

[21] Appl. No.: 736,994

[22] Filed: May 22, 1985

[51] Int. Cl.[4] ..... B21D 7/02

[52] U.S. Cl. ..... 72/217; 29/243.5; 72/458

[58] Field of Search ..... 29/243.5; 72/217, 218, 72/458, 459

[56] References Cited

U.S. PATENT DOCUMENTS

| | | | |
|---|---|---|---|
| 950,212 | 2/1910 | Schlosser et al. | 72/218 |
| 1,528,694 | 3/1925 | Riley | 72/218 |
| 1,762,234 | 6/1930 | Mathews | 72/218 |
| 3,685,335 | 8/1972 | Kowal | 72/218 |
| 4,155,239 | 5/1979 | Fjallstrom et al. | 72/218 |

FOREIGN PATENT DOCUMENTS

| | | | |
|---|---|---|---|
| 2098110 | 3/1982 | United Kingdom | 72/218 |

*Primary Examiner*—James L. Jones, Jr.
*Attorney, Agent, or Firm*—R. S. Lombard

[57] ABSTRACT

A conductor bundle edge-bending tool is disclosed. The apparatus is designed to bend a conductor bundle of a coil of a dynamoelectric generator along its edge. The apparatus is easy to use and prevents lateral deformation of the conductor bundle and provides a large mechanical advantage.

10 Claims, 8 Drawing Figures

CONDUCTOR BUNDLE EDGE-BENDING TOOL FOR A DYNAMOELECTRIC GENERATOR

BACKGROUND OF THE INVENTION

This invention relates generally to a dynamoelectric generator and, in particular, to a tool for bending the winding coils of such a generator along the edges of the individual conductors that make up the coils. As is known in the art the coils of a dynamoelectric generator include conductor bundles having elongated metallic conductors. These conductors typically have a thin rectangular cross-section resulting in a flat, wide top portion and a relatively narrow edge. When installing new coils in either a new generator or existing generator, difficulties are often encountered in bending the conductor bundles in a direction that results in the bending of the individual conductors along their edges. Such difficulties are not encountered when bending the individual conductors in a direction substantially perpendicular to the wide face portion of the individual conductors. Tools presently used for the bending of the conductor bundle in an edge-wise direction are not adjustable and fit only one size conductor bundle and further, there is very little mechanical advantage. Also, one tool presently used has a three foot long arm which makes the tool difficult in using in close quarters.

SUMMARY OF THE INVENTION

The present invention overcomes the difficulties encountered with the prior art tools. This invention provides a conductor bundle edge-bending tool for a dynamoelectric generator. The generator typically has a plurality of winding coils. Each of the coils has conductor bundle means including a plurality of elongated metallic conductors. Each of the conductors has a thin substantially rectangular cross-section. The cross-sections of each of the conductors have substantially equal dimensions and have a relatively wide face portion and a relatively narrow edge portion. The conductor bundle means includes a plurality of layers of the conductors. Each of the layers is formed by a plurality of the conductors. Each of the conductors of each of the layers are disposed such that at least one face portion of each of the conductors is adjacent to another face portion of another of the conductors. The edge portions of the conductors of each of the layers are aligned to form a top portion and a bottom portion of the layer. The layers are stacked in predetermined position to form the conductor bundle means. The conductor bundle means has a top layer and a bottom layer.

The tool comprises a gear means, including a first shaft. The first shaft has a driver gear mounted thereon. A second shaft is provided having a driven gear mounted thereon. The driven gear is in operable engagement with the driver gear. Gear housing means is provided enclosing and supporting the driver gear and the driven gear.

The tool also includes cylindrical mandrel means affixed to one end of the second shaft. The mandrel means is positioned exterior of the gear housing means. The mandrel means is in bending relationship with the conductor bundle upon engagement of the bundle with the tool. A bending roller means comprises a cylindrical roller of predetermined dimensions. A bracket means is affixed to the driven gear. A bending roller housing means includes a front plate and a rear plate. The bending roller means is mounted in predetermined position between the front and rear plates. The bending roller means is rotatably hinged at one end thereof to the bracket means to enable the bending roller to engage and disengage the conductor bundle.

The tool further includes adjustable front clamp means comprising second bracket means. The second bracket means is affixed to the gear housing. The adjustable clamp means is engageable with the top portion of the top layer of the conductor bundle. The clamp is positioned in predetermined position ahead of the mandrel means.

Adjustable guide means are provided disposed in predetermined positions for prevention of lateral deformation of the conductor bundle means during bending of the bundle means. A first handle means includes an elongated handle member affixed at one end to the gear housing means. A second handle means is provided engaging the other end of the first shaft, whereby when the conductor bundle means is positioned so as to contact the mandrel, the clamp is adjusted to engage the top portion of the top layer of the conductor bundle means and the roller is positioned to engage the top portion of the top layer of the conductor bundle. The adjustable guide means is positioned adjacent the bundle means and the second handle is turned thereby forcing the bending roller means against the conductor bundle means causing the bundle means to bend around the mandrel to form the desired bend in the conductor bundle while the guide means prevents lateral deformation of the bundle means. Preferably the second handle means includes a ratchet means for permitting ease of operation of the apparatus. Other embodiments of the invention are disclosed.

BRIEF DESCRIPTION OF THE DRAWINGS

For a better understanding of the invention, reference may be had to the accompanying drawings, in which.

BRIEF DESCRIPTION OF THE PREFERRED EMBODIMENT

Figure 1:
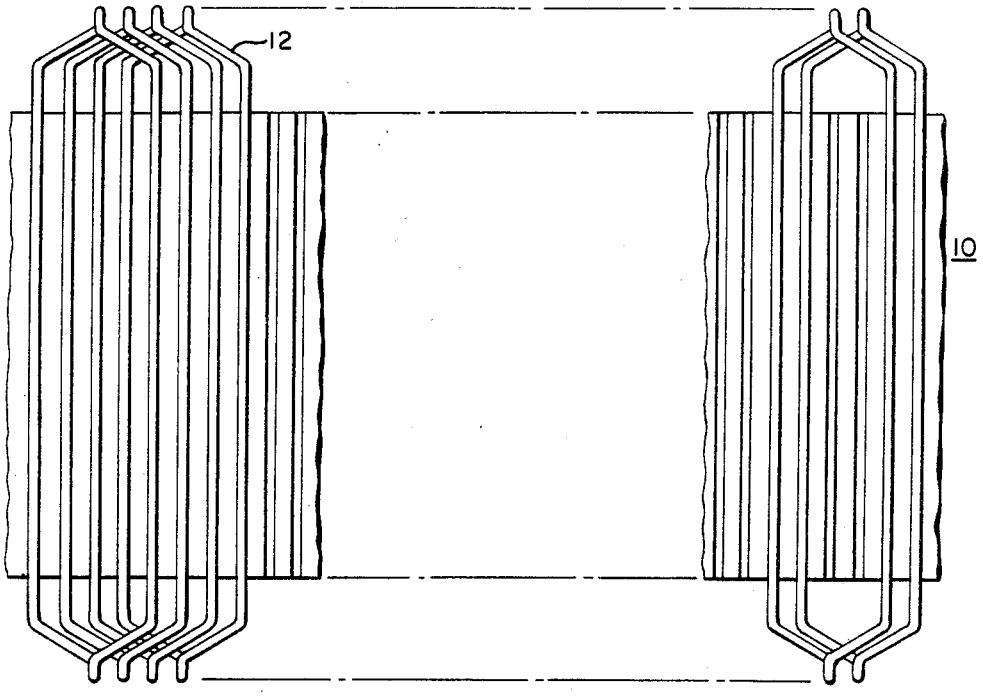
FIG. 1 is a sectional schematic view of a dynamoelectric generator.
Figure 3A:
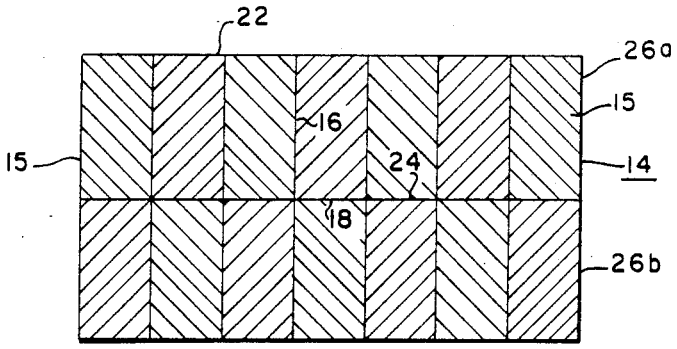
FIG. 3A is an exploded view of the conductor bundle cross-section shown in FIG. 2.
Figure 2:
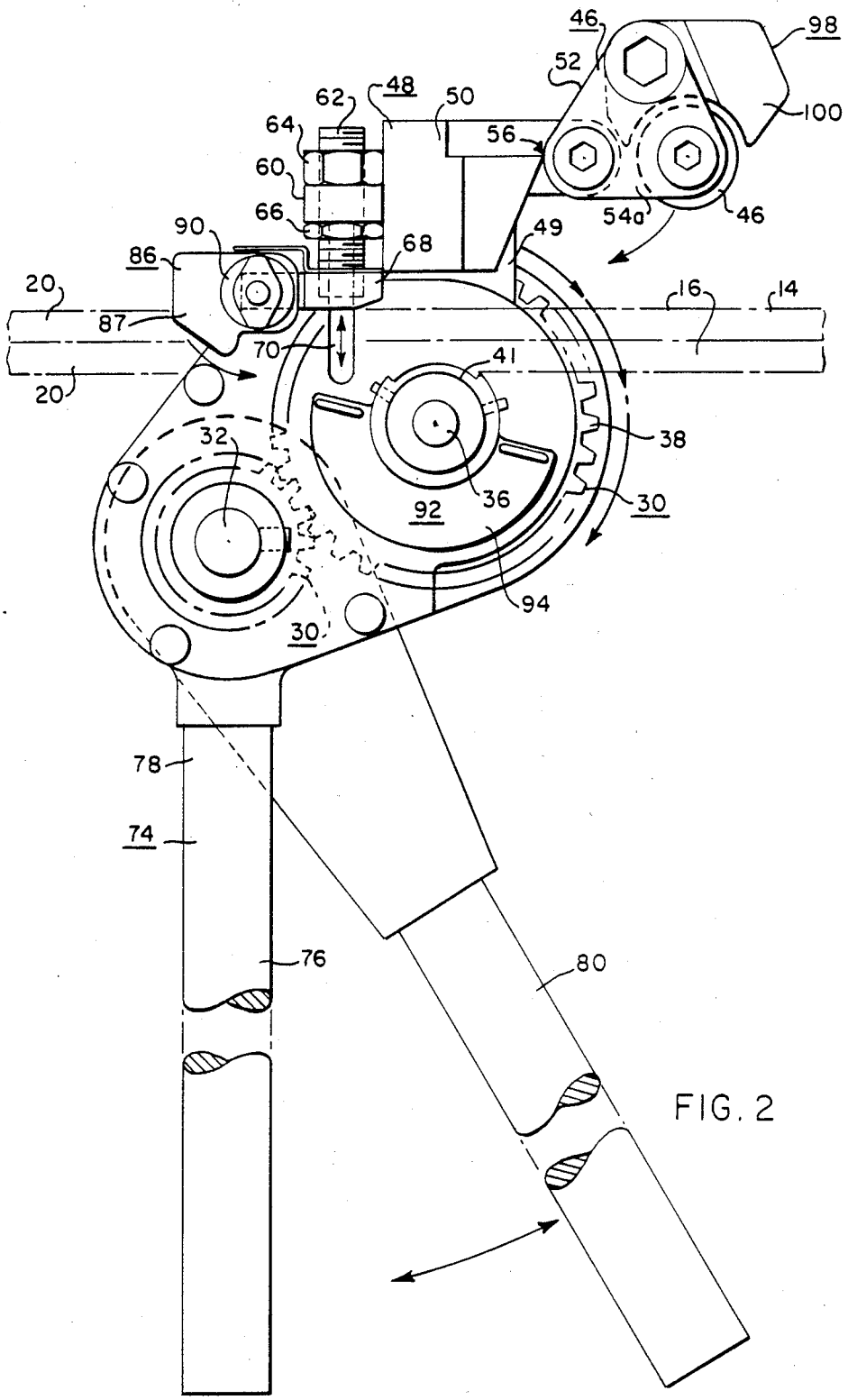
FIG. 2 is a front elevational view of the tool of the present invention showing the position of the conductor bundle upon initial positioning of the apparatus on the bundle.
Figure 3:
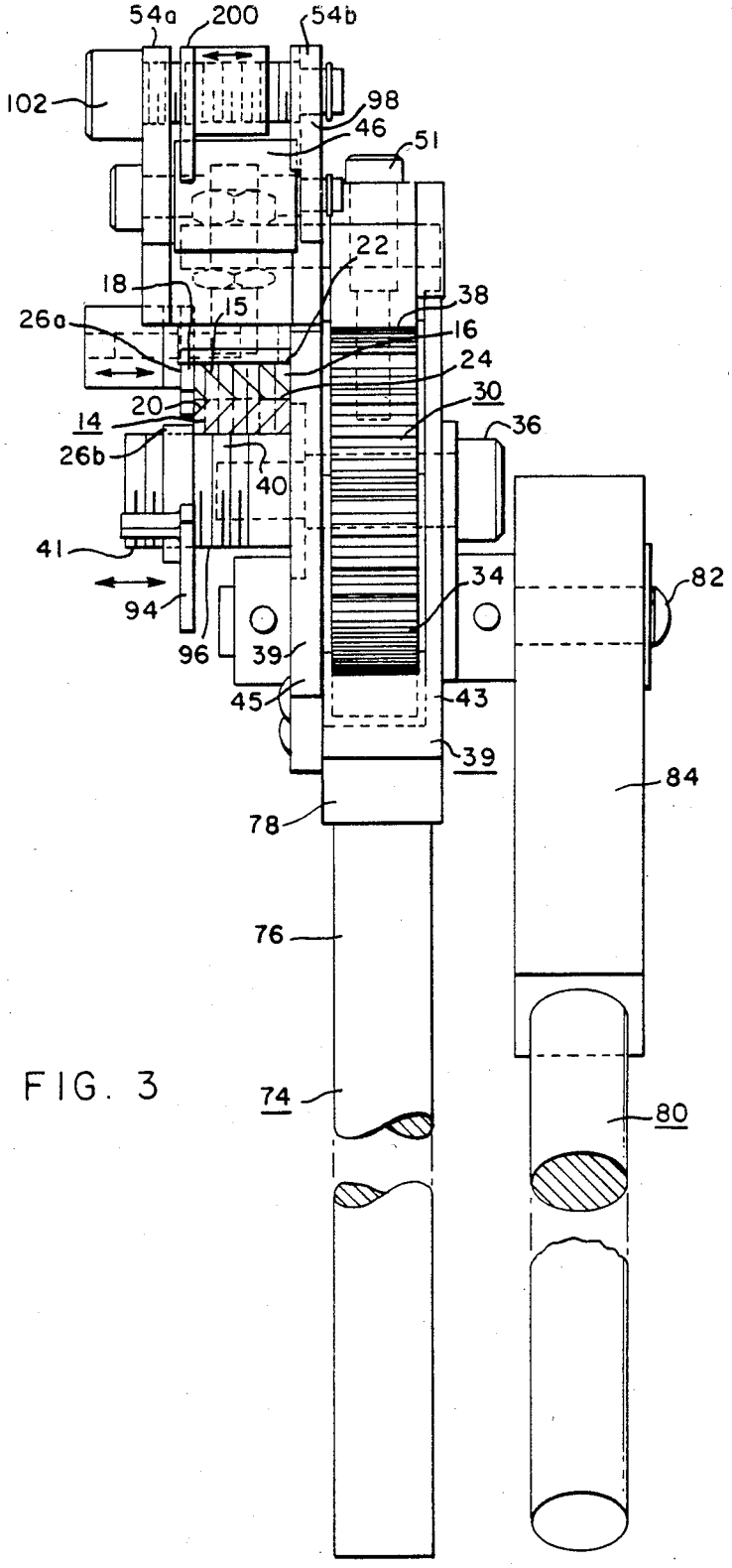
FIG. 3 is a right side elevational view of the tool shown in FIG. 2.

In FIG. 1 there is shown schematically a section of a dynamoelectric generator 10. The generator has a plurality of winding coils 12. Each of the coils 12 have conductor bundle means 14 as shown in FIGS. 2, 3 and 3A. Each of the conductors 14 have a thin substantially rectangular cross-section 15 as shown in FIGS. 3 and 3A. The cross-section 15 of each of the conductors 14 has substantially equal dimensions and has a relatively wide face portion 16 and a relatively narrow edge portion 18. In a hydrogenerator, for example, the face portion is typically 0.250" to 0.380" wide and the edge portion is typically 0.075" to 0.095" thick. The conductor bundle means 14 includes a plurality of layers 20 of conductors 15. Each of the layers 20 are formed by a plurality of the conductors 15. Each of the conductors 15 of each of the layers 20 are disposed such that at least one face portion 16 of each of the conductors 15 is adjacent to another face portion 16 of another of the conductors 15 and the edge portions 18 of the conductors 15 of each of the layers 20 are aligned to form a top portion 22 and a bottom portion 24 of the layer 20. The layers 20 are stacked in predetermined position to form the conductor bundle 14. The conductor bundle has a top layer 26*a* and a bottom layer 26*b*. The bundle 14 in a hydrogenerator for example are typically 0.5 to 0.8 inches thick and 0.5 to 1.0 inches wide.

Figure 4:
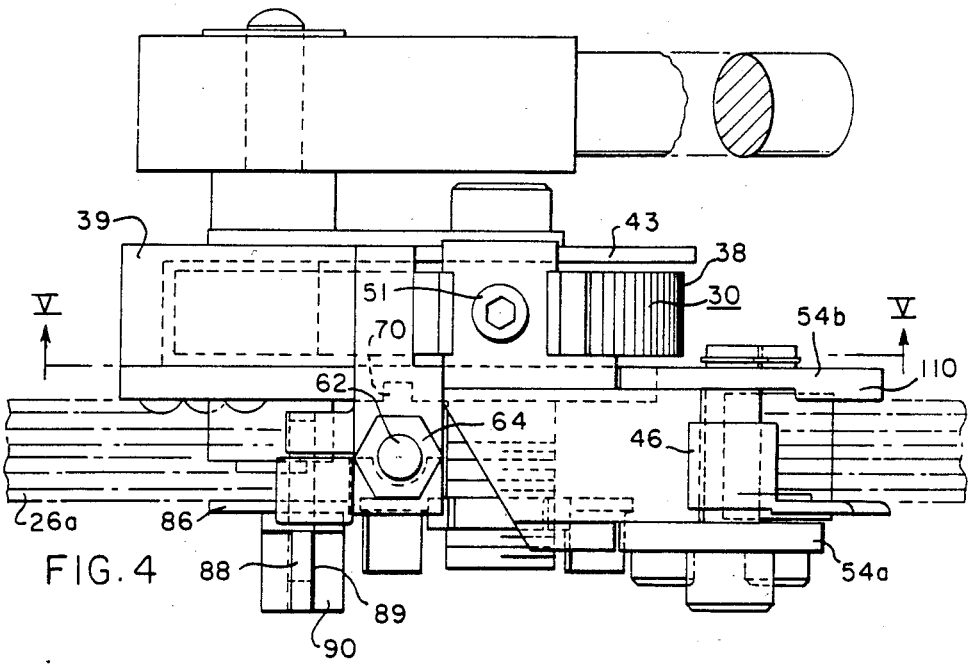
FIG. 4 is a plan view of the tool shown in FIG. 1.
Figure 5:
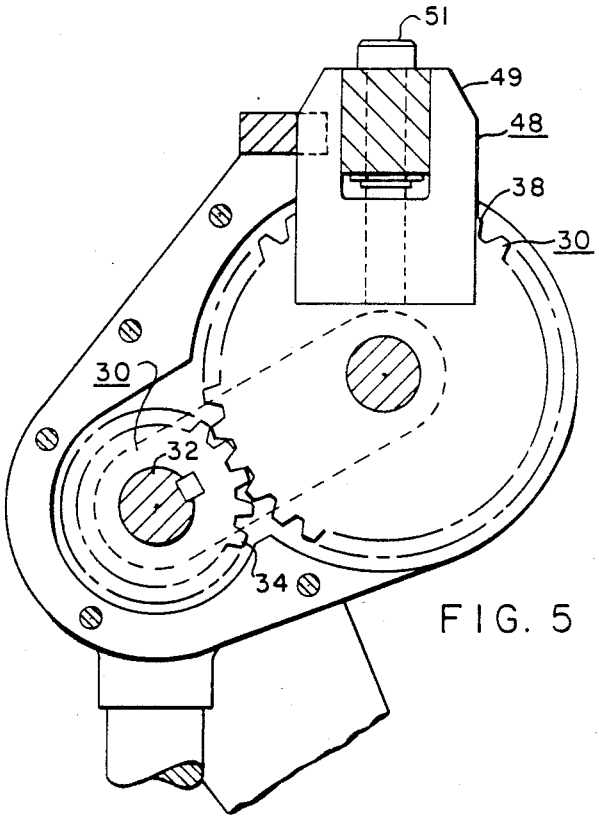
FIG. 5 is an elevational view of the tool partially broken away taken along the line V—V of FIG. 4.

Referring to FIGS. 2–7, the present invention provides a conductor bundle edge-bending tool 28 for a dynamoelectric generator shown in FIG. 1. The tool 28 is especially useful to do the required edge bending of the conductor bundles when connecting the coils together in a new generator or a rewinding operation. The tool 28 comprises gear means 30. The gear means 30 includes a first shaft 32 having a driver gear 34 mounted thereon. The gear means 30 further includes a second shaft 36 having a driven gear 38 mounted thereon. The driven gear 38 is in operable engagement with the driver gear 34 as shown in FIG. 5. The driver gear 34 may be a right-hand helical gear such as manufactured by Boston Gear Company catalogue No. H1218R and the driven gear may be a left-hand helical gear such as manufactured by Boston Gear Company catalogue No. H1236L, for example. A gear housing means 39 is provided enclosing and supporting the driven gear 34 and the driven gear 38. The gear housing means 39 includes rear housing cover 43 and front housing cover 45.

The tool 28 further comprises cylindrical mandrel means 40 as shown in FIG. 3. As shown in FIG. 3, the cylindrical mandrel 40 is affixed to the front housing cover 45 proximate one end of the second shaft 36 by welding, for example. The mandrel 40 is positioned exterior of the gear housing means 39. The mandrel means 40 is in bending relationship with the conductor bundle 14 shown in FIGS. 3, 6 and 7 upon engagement of the bundle 14 with the apparatus 28.

The tool 28 further includes bending roller means 44 comprising a cylindrical roller 46 of predetermined dimensions such as 1.0" diameter ×1.115 long. The bending roller means 44 also includes bracket means 48 affixed, to the driven gear 38 as shown in FIG. 5. Preferably the bracket means includes lower support member 49. The driven gear as shown in FIG. 5 has been cut out to receive the lower support member 49. The lower support member 49 is then affixed to the driven gear by welding, for example. The bracket means 48 also includes upper support member 50 which is affixed to the lower support member 49 as shown in FIG. 2 through first adjustment bolt means 51. A bending roller housing means 52 includes a front plate 54*a* and a rear plate 54*b*. The roller 46 is mounted in predetermined position between the front plate 54*a* and the rear plate 54*b* as shown in FIG. 3. The bending roller housing means 52 is rotatably hinged at one end 56 of the bracket 48 as shown in FIG. 2 to enable the bending roller 46 to engage and disengage the conductor bundle 14. The position of the bending roller housing means 52 can be changed through the first adjustment bolt means 51 to vary the gap between the roller 46 and the mandrel 40. The size of the gap may vary from 0.5" to 0.8".

Figure 6:
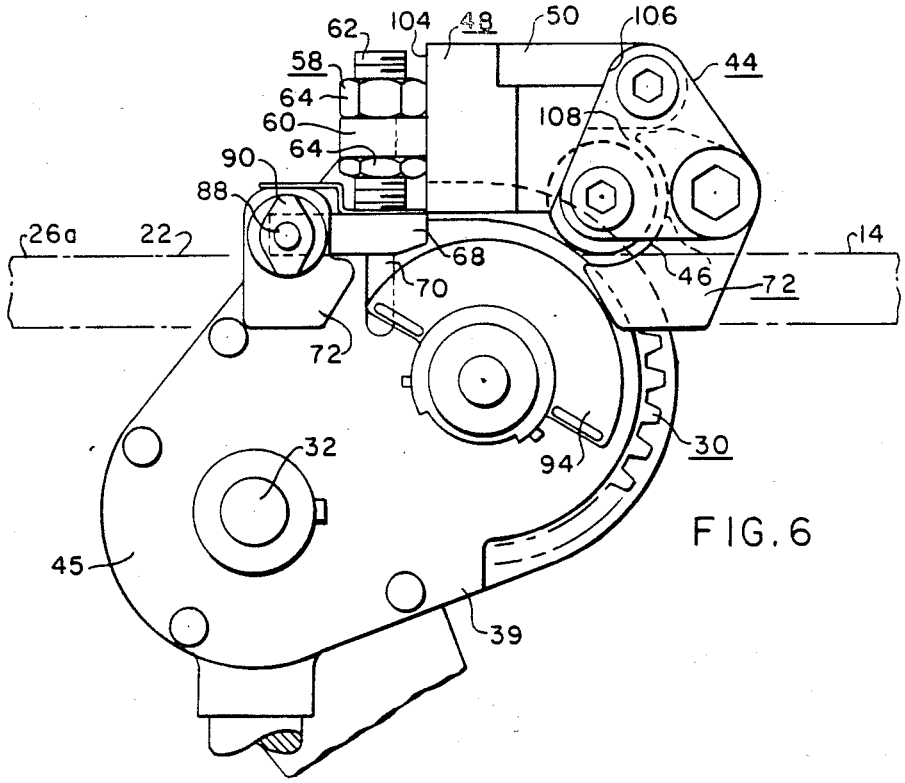
FIG. 6 is a sectional elevational view showing the bending roller, the adjustable front clamp and the adjustable guide means in final position prior to bending the conductor bundle.

The tool 28 also includes adjustable front clamp means 58 comprising second bracket means 60. The adjustable front clamp 58 provides opposing force to that of the roller 46 during the bending operation. Second bracket means 60 is affixed to the rear housing cover 43. The adjustable clamp member also includes threaded member 62, upper nut 64 and lower nut 66. The adjustable front clamp means also includes clamp members 68. Front cover 45 is preferably provided with a slot 70 as shown in FIG. 6 which the rear portion 67 of the clamp member 68 rides. As shown in FIG. 6 the adjustable front clamp means 58 engages the top portion of the top layer 26*a* of the conductor bundle 14. The clamp 58 is positioned in predetermined position ahead of the mandrel 40.

The tool 28 further includes adjustable guide means 72 for prevention of lateral deformation of the conductor bundle during bending of the bundle. A first handle means 74 is provided including an elongated handle member 76 which is affixed at one end 78 to the gear housing 39. A second handle means 80 engages the other end 82 of the first shaft 32, whereby when the conductor bundle 14 is positioned as to contact the mandrel 40 the adjustable front clamp means 58 is adjusted to engage the top portion 22 of the conductor bundle 14 and the roller 46 is positioned to engage the top portion of the top layer 26*a* of the conductor bundle 14. The adjustable guide means 72 are positioned adjacent the conductor bundle 14 and the second handle 80 is turned thereby forcing the bending roller 46 against the conductor bundle 14 causing the bundle 14 to bend around the mandrel 40 to form the desired bend, while the guide means 72 prevents lateral deformation of the bundle 14. See FIGS. 6 and 7.

Figure 7:
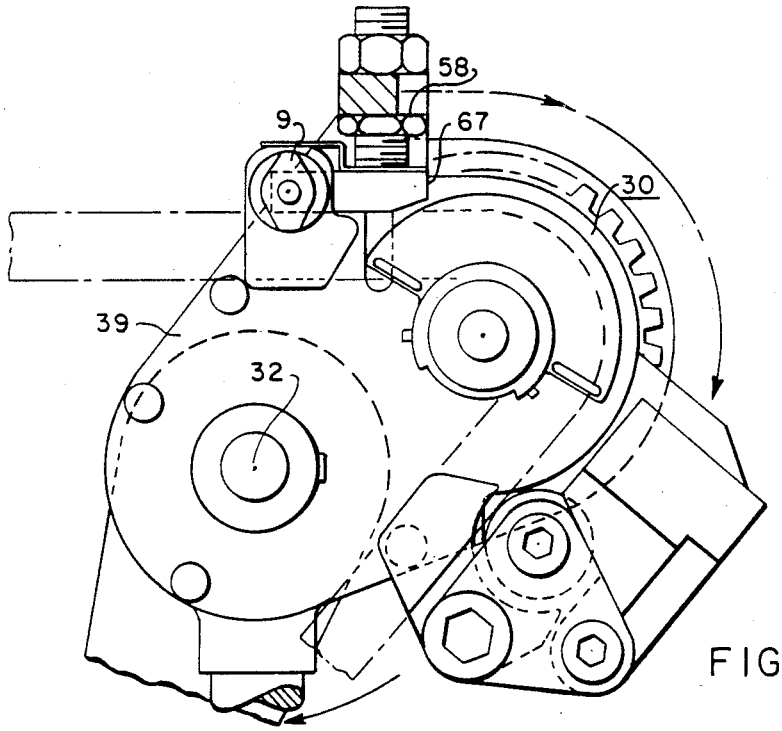
FIG. 7 is a sectional elevational view of the apparatus showing the position of the bending roller means upon completion of a bend in the conductor bundle.

Preferably, the second handle means 80 includes ratchet means 84. The ratchet means 84 may be a standard item such as the ratchet arm manufactured by Lowell Corporation series 20, handle No. 23 with a 0.50 square hole, 12 inches in length. Preferably the guide means 72 includes a first guide means 86 as shown in FIG. 2 affixed to the housing means 39 through clamp member 68 in predetermined position ahead of the mandrel 40. The first guide means 86 includes first flange member 87 which is slidably mounted on third shaft 88 which is supported by the clamp member 68. Third shaft 88 is preferably provided with first threading 89 as shown in FIG. 4. Tightening member 90 is mounted on the end of the third shaft 88 and is tightened to engage the bundle after the first guide 86 is rotated and positioned to contact the bundle. After the bending operation is complete tightening member 90 is loosened and first guide 86 is raised to permit the removal of the apparatus from the conductor bundle 14. Preferably the guide means 72 comprises second guide means 92 affixed to one end 41 of the mandrel 40 rotatably mounted thereon. The second guide means 92 preferably comprises a second flange member 94 as shown in FIGS. 2 and 3. The mandrel 40 is preferably provided with second threading 96 so that the second flange 94 may be screwed down to a position adjacent the conductor bundle prior to bending of the bundle 14 and then unscrewed after the bend has been completed. It is not necessary that the second rotatable flange 94 contact the conductor bundle as long as the clearance between the second flange and the conductor bundle 14 is small such as 0.02". The guide means 72 also preferably comprises third guide means 98. Third guide means 98 preferably comprises a third flange member 100 affixed to the bending roller means 44 as shown in FIG. 3. The third guide means 98 also preferably includes a second adjustment bolt means 102. The bolt 102 preferably supports and positions the third flange member 100. The flange is positioned to engage the conductor bundle during bending of the bundle 14 as shown in FIGS. 4, 6 and 7. Preferably rear plate **54*b* is provided with a flange portion 110 aligned with the third flange 100. The flange portion 110** aids in preventing lateral deformation of the bundle.

The upper support member 50 is provided with a left-edge portion 104 and a right-edge portion 106. As can be seen in FIG. 6 the left edge portion 104 is positioned perpendicular to the conductor bundle when the tool initially engages the conductor bundle 14. The right-edge portion 106 forms an angle of 20° with the perpendicular. As can be seen in FIG. 6, when the bending roller means is placed in the position to engage the bundle 14 the one side 108 of front plate **54*a* and rear plate 54*b* of the bending roller housing 52 is made to contact the right-edge member of the upper support 50** along substantially its entire length. This design maintains the bending roller in engagement against the conductor bundle during the bending operation.

The conductor bundle edge-bending tool 28 of the present invention provides a hand tool for field use especially suited for hydrogenerator rewinding projects where it is necessary to form 90° edge bends in conductor bundles 14. As is known in the art these bundles vary in size depending on the number of turns in the winding or coil and the size of the individual conductors 15. The present tool 18 is designed to confine the conductor bundle 14 on all sides to prevent spreading during bending. The tool is adjustable to fit all typical bundle 14 sizes from 0.5 to 0.8 inches in thickness and 0.5 to 1.0 inches wide without interchanging the forming tools and guides. As can be seen the tool loads and unloads easily from the side without disassembly. With the embodiment as described the helical gear train has a two-to-one gear ratio. The ratchet drive allows operation where space is limited. The maximum bend that can be formed by the apparatus of the present embodiment is 110 degrees.

The mechanical configuration of the tool 28 results in a 24 to 1 mechanical advantage.

In operation with the tool the adjustable front clamp 58 must be adjusted to the clamp 58 lies flat across the top layer **26*a* of the conductor bundle. After the clamp 58 is positioned the roller 46 must be adjusted utilizing first adjustment bolt 51 to the same approximate height as the clamp 58 relative to the mandrel 40. The width of the bundle 14 to be bent is then measured and the first guide, second guide 92 and third guide 98 are adjusted to a width greater than the width of the bundle 14. The conductor bundle is then prepared for bending. If the conductors 15 of the bundle 14 are bent they must be straightened. Preferably, the bundle 14 should be as straight and tightly backed as possible. All tape or insulation wrapped around the bundle 14 in the area to be bent should be removed. The guide means 72 are pivoted or rotated to allow insertion of the bundle 14 between the clamp 58 and the mandrel 40. The apparatus is placed on the bundle 14 at the area to be bent. The free end of the bundle 14 should always be to the roller 46 side of the tool 28. The guide means 72 are rotated or pivoted to engage the bundle 14. The bundle 14 is then ready for bending. After the bend is completed the guide means 72 are rotated or pivoted away from the bundle 14, and the tool 28** is removed.

We claim:

1. A conductor bundle edge bending tool for a dynamoelectric generator, said generator having a plurality of winding coils, each of said coils having conductor bundle means including a plurality of elongated metallic conductors, each of said conductors having a thin substantially rectangular cross-section, said cross-section of each of said conductors having substantially equal dimensions and having a relatively wide face portion and a relatively narrow edge portion, said conductor bundle means including a plurality of layers of said conductors, each of said layers formed by a plurality of said conductors, each of said conductors of each of said layers disposed such that at least one face portion of each of said conductors is adjacent another face portion of another of said conductors and said edge portions of said conductors of each of said layers are aligned to form a top portion and a bottom portion of said layer, said layers stacked in predetermined position to form said conductor bundle means, said conductor bundle means having a top layer and a bottom layer, said tool comprising:

(a) gear means including a first shaft, said first shaft having a driver gear mounted thereon, a second shaft, said second shaft having a driven gear mounted thereon, said driven gear in operable engagement with said driver gear, gear housing means enclosing and supporting said driver gear and said driven gear;

(b) cylindrical mandrel means affixed to one end of said second shaft, said mandrel means positioned exterior of said gear housing means, said mandrel means in bending relationship with said conductor bundle upon engagement of said bundle with said tool;

(c) bending roller means comprising a cylindrical roller of predetermined dimensions, bracket means affixed to said driven gear, bending roller housing means including a front plate and a rear plate, said bending roller means mounted in predetermined position between said front and rear plates, said bending roller means rotatably hinged at one end of said bracket means to enable said bending roller to engage and disengage said conductor bundle;

(d) adjustable front clamp means comprising second bracket means, said second bracket means affixed to said gear housing, said adjustable clamp means engageable with said top portion of said top layer of said conductor bundle, said clamp positioned in predetermined position ahead of said mandrel means;

(e) adjustable guide means disposed in predetermined positions for prevention of lateral deformation of said conductor bundle means during bending of said bundle means;

(f) first handle means including an elongated handle member affixed at one end to said gear housing means;

(g) second handle means engaging the other end of said first shaft, whereby said conductor bundle means is positioned so as to contact said mandrel, said clamp means is adjusted to engage said top portion of said top layer of said conductor bundle means and said roller is positioned to engage said top portion of said top layer of said conductor bundle, said adjustable guide means is positioned adjacent said bundle means and said second handle is turned thereby forcing said bending roller means against said conductor bundle means causing said bundle means to bend around said mandrel, to form the bend desired, while said guide means prevents lateral deformation of said bundle means.

2. The tool of claim 1, wherein said second handle means includes ratchet means.

3. The tool of claim 1, wherein said guide means includes a first guide means affixed to said housing means in predetermined position ahead of said mandrel means, second guide means affixed to said one end of said mandrel means rotatably mounted thereon, third guide means affixed to said bending roller means in predetermined position after said mandrel means.

4. The tool of claim 1, wherein said bending roller means includes first adjustment bolt means for adjusting said bending roller to the size of the conductor bundle to be bent.

5. The tool of claim 1, wherein said first guide means comprises a first flange member.

6. The tool of claim 1, wherein said second guide means comprises a second flange member.

7. The tool of claim 1, wherein said third guide means comprises a third flange member.

8. The tool of claim 7, wherein said third guide means further comprises a second adjustment bolt means.

9. The tool of claim 1, further comprising guide slot means for providing rigidity for the adjustable front clamp means.

10. The tool of claim 1, wherein the gear ratio between said driver gear and said driven gear is 2 to 1.

* * * * *